United States Patent [19]

Cheresnowsky

[11] Patent Number: 4,798,623

[45] Date of Patent: Jan. 17, 1989

[54] METHOD FOR PRODUCING FINE COBALT METAL POWDER

[75] Inventor: Michael J. Cheresnowsky, Towanda, Pa.

[73] Assignee: GTE Products Corporation, Stamford, Conn.

[21] Appl. No.: 157,669

[22] Filed: Feb. 19, 1988

[51] Int. Cl.[4] ..... B22F 9/26

[52] U.S. Cl. ..... 75/0.5 AA; 75/108; 75/119

[58] Field of Search ..... 75/0.5 AA, 0.5 BA, 108, 75/119

[56] References Cited

U.S. PATENT DOCUMENTS

| | | | |
|---|---|---|---|
| 4,093,450 | 6/1978 | Doyle et al. | 75/0.5 AA |
| 4,184,868 | 1/1980 | Ritsko et al. | 75/0.5 AA |
| 4,214,894 | 7/1980 | Ritsko et al. | 75/0.5 AA |
| 4,214,895 | 7/1980 | Gingerich et al. | 75/0.5 AA |
| 4,214,896 | 7/1980 | Cheresnowsky | 75/0.5 AA |
| 4,218,240 | 8/1980 | Gingerich et al. | 75/0.5 AA |
| 4,233,063 | 11/1980 | Ritsko et al. | 75/0.5 AA |
| 4,278,463 | 7/1981 | Vanderpool et al. | 75/0.5 A |
| 4,329,169 | 5/1982 | Gingerich et al. | 75/0.5 AA |
| 4,348,224 | 9/1982 | Gingerich et al. | 75/0.5 AA |
| 4,381,937 | 5/1983 | Gingerich et al. | 75/0.5 AA |
| 4,395,278 | 7/1983 | Vanderpool et al. | 75/0.5 AA |
| 4,409,019 | 10/1983 | Vanderpool et al. | 75/0.5 AA |
| 4,452,633 | 6/1984 | Miller et al. | 75/0.5 AA |
| 4,469,505 | 9/1984 | Cheresnowsky | 75/0.5 AA |
| 4,612,039 | 9/1986 | Scheithauer et al. | 75/0.5 AA |
| 4,690,710 | 9/1987 | Scheithauer et al. | 75/0.5 AA |
| 4,705,559 | 11/1987 | Miller | 75/0.5 AA |

*Primary Examiner*—Wayland Stallard

*Attorney, Agent, or Firm*—Donald R. Castle; L. Rita Quatrini

[57] ABSTRACT

A method is disclosed for producing fine cobalt metal powder which comprises adding to a solution of cobaltous chloride, sodium hydroxide in an amount equal to at least the stoichiometric amount required to form a precipitate of the major portion of the cobalt as cobaltous hydroxide and a mother liquor containing the balance of the starting cobalt, separating the precipitate from the mother liquor, water washing the precipitate to remove essentially all of the sodium therefrom, and reducing the precipitate to fine cobalt metal powder having an FSSS of from about 0.5 to about 2.0. Drying of the precipitate before reduction results in the fine cobalt metal powder having essentially no tailings.

4 Claims, No Drawings

METHOD FOR PRODUCING FINE COBALT METAL POWDER

This invention relates to a method for recovering fine cobalt metal powder by forming cobaltous hydroxide from a solution of cobaltous chloride and thereafter reducing the cobaltous hydroxide to fine cobalt powder.

BACKGROUND OF THE INVENTION

Fine cobalt metal powder has been produced by converting cobalt chloride to either pentammine cobalt chloride or hexammine cobalt (III) chloride and thereafter converting these ammine complexes to cobaltic hydroxide which is then reduced to the metal. Disadvantages of these processes are high chemical costs associated with the use of relatively expensive ammonia which is used in the oxidation and subsequent acidification used in purification. Also, relatively large amounts of sodium hydroxide are required to neutralize the solution to precipitate cobaltic hydroxide.

Therefore a process which overcomes the above disadvantages would be desirable.

The following U.S. Patents relate to cobalt processing:

U.S. Pat. No. 4,184,868 relates to a method for producing extra fine cobalt metal powder by digesting cobalt pentammine chloride in ammonium hydroxide to obtain a black precipitate which contains cobalt and which is thereafter reduced to metal powder. U.S. Pat. No. 4,214,894, 4,233,063, and 4,278,463 relate to improvements in U.S. Pat. No. 4,184,868 in which the ammonia solutions are processed to recover any cobalt therein. U.S. Pat. No. 4,395,278 and 4,469,505 relate to improvements in U.S. Pat. No. 4,184,868 in which fine cobalt metal powder is produced having reduced tailings.

U.S. Pat. No. 4,214,895 relates to a process for producing cobalt metal powder which involves treating an aqueous solution of a soluble cobaltic ammine halide with a sufficient amount of a soluble metallic hydroxide to form a cobalt containing precipitate which is thereafter reduced to metallic cobalt.

U.S. Pat. No. 4,218,240 relates to a method for producing cobalt metal powder by forming a solution of a cobalt hexammine compound and treating the solution with a metallic hydroxide to form a precipitate which is reduced to cobalt metal powder. U.S. Pat. Nos. 4,348,224 and 4,381,937 relate to improvements in the process described in U.S. Pat. No. 4,218,240 which involve removal of copper and silver from the cobalt. U.S. Pat. No. 4,452,633 relates to an improvement in the processes described in U.S. Pat. Nos. 4,218,240 and 4,348,224 in which the silver is recovered.

U.S. Pat. No. 4,093,450 to Doyle et al describes a process for producing fine particle size cobalt metal powder by the hydrogen reduction of cobalt oxide obtained from a cobalt pentammine carbonate solution. The precipitate is formed by heating the solution to drive off ammonia and carbon dioxide to form a precipitate of cobalt oxide.

U.S. Pat. No. 4,329,169 relates to a process for producing fine cobalt metal powder absent tailings by heating an aqueous solution of soluble cobalt ammine halide to decompose the halide and form a cobalt containing precipitate which is reduced to the cobalt metal powder.

U.S. Pat. No. 4,409,019 relates to a process for producing fine cobalt metal powder from pieces of relatively pure cobalt by dissolving the cobalt pieces in an aqueous solution of hydrogen iodide and iodine and forming a cobalt containing solid which is subsequently reduced to a fine cobalt metal powder.

SUMMARY OF THE INVENTION

In accordance with one aspect of this invention, there is provided a method for producing fine cobalt metal powder which comprises adding to a solution of cobaltous chloride, sodium hydroxide in an amount equal to at least the stoichiometric amount required to form a precipitate of the major portion of the cobalt as cobaltous hydroxide and a mother liquor containing the balance of the starting cobalt, separating the precipitate from the mother liquor, water washing the precipitate to remove essentially all of the sodium therefrom, and reducing the precipitate to fine cobalt metal powder having an FSSS of from about 0.5 to about 2.0.

In accordance with another aspect of this invention, drying of the precipitate before reduction results in the fine cobalt metal powder having essentially no tailings.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

This invention relates to a method for producing fine cobalt metal powder by reducing cobalt hydroxide which has been precipitated from a cobaltous chloride solution. The present invention affords the advantages of reduced cost over the prior methods of producing cobalt metal powder via formation of cobalt pentammine chloride or cobalt hexammine chloride because there is no consumption of acid or ammonia.

The starting cobalt solution is a cobaltous chloride solution. The typical cobalt concentration is from about 20 to about 66 g Co/l. The solution can be derived from any source such as by acid leaching tungsten carbide containing cobalt.

To the cobaltous chloride solution is added sodium hydroxide in an amount equal to at least the stoichiometric amount required to form a precipitate of cobaltous hydroxide of the major portion of the cobalt. The preferred amount of NaOH is about 2 moles per mole of cobalt. In the previous methods via pentammine and hexammine about 3 moles of NaOH are required per mole of cobalt. The sodium hydroxide can be added in any convenient form such as in the solid form or in a concentrated solution as 19N NaOH. It is more advantageous to add the NaOH as a solid or in concentrated form to avoid diluting the cobalt.

In accordance with a preferred embodiment, the solution is agitated and the temperature is raised to about 35° C. to facilitate the start of the reaction. After all the sodium hydroxide is added, the temperature is raised to about 60° C. to convert the cobaltous hydroxide from the blue form to the pink form which is more easily filtered. More typically essentially all of the cobalt precipitates as cobaltous hydroxide. In order to obtain the pink form of cobalt hydroxide, the cobalt chloride solution can be added to a sodium hydroxide solution containing the proper amount of sodium hydroxide. In this case, the pink cobalt hydroxide forms at room temperature.

The precipitate is then separated from the resulting mother liquor by standard techniques such as filtration.

The cobalt hydroxide precipitate is then water washed to remove essentially all of the sodium therefrom. During the washing, some of the cobalt is converted to brown cobalt oxide hydrate. However, this is not detrimental because all the cobalt subsequently reduces to the metal.

The washed cobaltous hydroxide is then reduced in hydrogen to cobalt metal powder. The usual reduction conditions, although the invention is not limited to such are a temperature of from about 450° C. to about 550° C. for from about two hours to about four hours. The particle size of the resulting cobalt metal powder has a Fisher subseive size, FSSS, of from about 0.50 to about 2.0, and more typically from about 0.75 to about 1.75.

Table 1 shows the particle size of the cobalt metal powder produced by the method of the present invention.

TABLE 1

| Run # | g Co/l | FSSS | BET area ($m^2/g$) | BET diameter ($\mu m$) | % tailings |
|---|---|---|---|---|---|
| 1 | 22 | 0.86 | 1.29 | 0.52 | 77 |
| 2 | 22 | 0.72 | 1.78 | 0.38 | 66 |
| 3 | 44 | 1.34 | 0.938 | 0.72 | 19 |
| 4 | 66 | 1.00 | 1.39 | 0.48 | 8.6 |

In Run #1, $CoCl_2$ was added to NaOH.
In Runs 2 through 4 NaOH was added to $CoCl_2$.

If any tailings are present, they are soft and are easily broken down. This is a major advantage of the present invention.

The higher the cobalt concentrations, the higher the sodium level. The sodium can be removed by washing of the cobaltous hydroxide prior to reduction or drying.

Prior to reduction it is preferred that the precipitate of cobalt hydroxide/cobalt oxide hydrate be dried. Table 2 shows that there are essentially no tailings in the material that was predried as opposed to the material which is reduced in the wet condition.

TABLE 2

| Run # | Description | FSSS | BET area ($m^2/g$) | BET diameter ($\mu m$) | % Tailings |
|---|---|---|---|---|---|
| 5* | Reduced wet | 0.73 | 1.94 | 0.35 | 61 |
| 6** | Dried then reduced | 0.96 | 1.64 | 0.41 | 0 |

*Reduced at 400° C.
**Dried at 100° C., reduced at 400° C.

While there has been shown and described what are at present considered the preferred embodiments of the invention, it will be obvious to those skilled in the art that various changes and modifications may be made therein without departing from the scope of the invention as defined by the appended claims.

What is claimed is:

1. A method for producing fine cobalt powder, said method comprising:
   (a) adding to a solution of cobaltous chloride, sodium hydroxide in an amount equal at least to the stoichiometric amount required to form a precipitate of the major portion of the cobalt as cobaltous hydroxide and a mother liquor containing the balance of the starting cobalt;
   (b) separating said precipitate from said mother liquor;
   (c) water washing said precipitate to remove essentially all of the sodium therefrom; and
   (d) reducing said precipitate to fine cobalt metal powder having a FSSS of from about 0.5 to about 2.0.

2. A method of claim 1 wherein said cobalt chloride solution contains from about 20 to about 66 g Co/l.

3. A method of claim 1 wherein said FSSS is from about 0.75 to about 1.75.

4. A method of claim 1 wherein prior to the reduction step, said precipitate is dried to produce a metal powder having essentially no tailings after said reduction step.

* * * * *